United States Patent [19]

Smith, Jr.

[11] 4,044,674

[45] Aug. 30, 1977

[54] SPRAY DAMPENING SYSTEM FOR HIGH QUALITY OFFSET PRINTING

[75] Inventor: Roy R. Smith, Jr., Leawood, Kans.

[73] Assignee: Smith R.P.M. Corporation, Lenexa, Kans.

[21] Appl. No.: 637,879

[22] Filed: Dec. 5, 1975

Related U.S. Application Data

[63] Continuation-in-part of Ser. No. 491,290, July 24, 1974, abandoned.

[51] Int. Cl.[2] ..... B41F 7/30

[52] U.S. Cl. ..... 101/148; 101/366

[58] Field of Search ..... 101/147, 148, 366, 425; 118/259, 313, 315, 323

[56] References Cited

U.S. PATENT DOCUMENTS

| | | | |
|---|---|---|---|
| 2,408,449 | 10/1946 | Russell | 101/147 |
| 2,448,226 | 8/1948 | Marsden | 101/147 |
| 2,960,929 | 11/1960 | Erzinger | 101/147 |
| 3,072,049 | 1/1963 | Huebner | 101/147 |
| 3,094,065 | 6/1963 | Roberts | 101/148 |
| 3,139,028 | 6/1964 | Huebner | 118/315 X |
| 3,282,273 | 11/1966 | Johnston et al. | 118/323 X |
| 3,302,296 | 2/1967 | Holmwood et al. | 101/148 X |
| 3,308,754 | 3/1967 | Munn | 101/348 |
| 3,431,842 | 3/1969 | Winkler et al. | 101/148 |
| 3,508,489 | 4/1970 | Norton | 101/148 |
| 3,651,756 | 3/1972 | Smith, Jr. | 101/147 |
| 3,924,531 | 12/1975 | Klingler | 101/147 |

*Primary Examiner*—J. Reed Fisher

*Attorney, Agent, or Firm*—Fishburn, Gold & Litman

[57] ABSTRACT

Dampening rolls receive spray from a multi-nozzle spray member having a spray path extending beyond the ends of the rolls. Overspray preventing shields are mounted at opposite ends of the spray path and have free dripping lower portions positioned over the dampening rolls. An oscillating roll runs against a dampening roll to spread the moisture film and a wet form roll provides contact between the oscillating roll and the plate cylinder. Preferably, the spray member oscillates transversely along the dampening rolls and separate shields are mounted on the spray member and fixed with respect to the press frame.

5 Claims, 14 Drawing Figures

SPRAY DAMPENING SYSTEM FOR HIGH QUALITY OFFSET PRINTING

This is a continuation-in-part of application Ser. No. 491,290, filed July 24, 1974, now abandoned.

This invention relates to moistening apparatus for lithographic printing presses and more particularly to an improved spray dampening system for high quality offset printing.

Basic spray dampening systems suitable for highly satisfactory operation under varied conditions of press feed, paper surface and ink requirements are known, for example, see U.S. Pat. No. 3,651,756 issued Mar. 28, 1972. However, where very high quality printing on certain very smooth paper is required, such dampening systems tend to occasionally produce slight printing irregularities or streaks corresponding to minor variations in the density of moisture disposition along the spray path. Particularly troublesome in this regard is the moisture disposition at the ends of the spray receiving roll or rolls, since it requires the end spray nozzles to be placed in positions which result in roll end overspray which tends to wet adjacent shafts and machine parts. This is especially undesirable in the meticulously maintained presses utilized for very high quality printing. Attempts to circumvent the problem by utilizing extra long and/or reciprocating rollers to respectively receive and smooth the uneven moisture film heretofore have been either impractical or create new problems, such as excess water or ink forming into rings at the edge of rolls and being slung off at high rotational speeds.

The principal objects of the present invention are: to provide spray dampening apparatus for high quality offset printing presses which creates a highly uniform moisture film application; to provide such a system wherein the spray is applied to dampening rolls without edge overspray; to provide such a system wherein the spray member is reciprocated for additional moisture film uniformity; to provide such offset press dampening apparatus which permits end spray nozzles to be placed in overspray positions without producing overspray; to provide overspray preventing apparatus which utilizes unique shields positioned to intersect and prevent overspray; to provide such shields which have free dripping lower portions positioned over dampening rolls; to provide such shields which are mounted on a reciprocating spray member; to provide such spray shield arrangements which include cooperating shields mounted on the spray member and fixed with respect to the press frame; and to provide such an arrangement which is relatively inexpensive to produce, reliable in use, easily maintained and generally well adapted for its intended purpose.

Other objects and advantages of this invention will become apparent from the following description taken in connection with the accompanying drawings wherein are set forth by way of illustration and example certain embodiments of this invention.

Figures 1, 2, 5, 6:
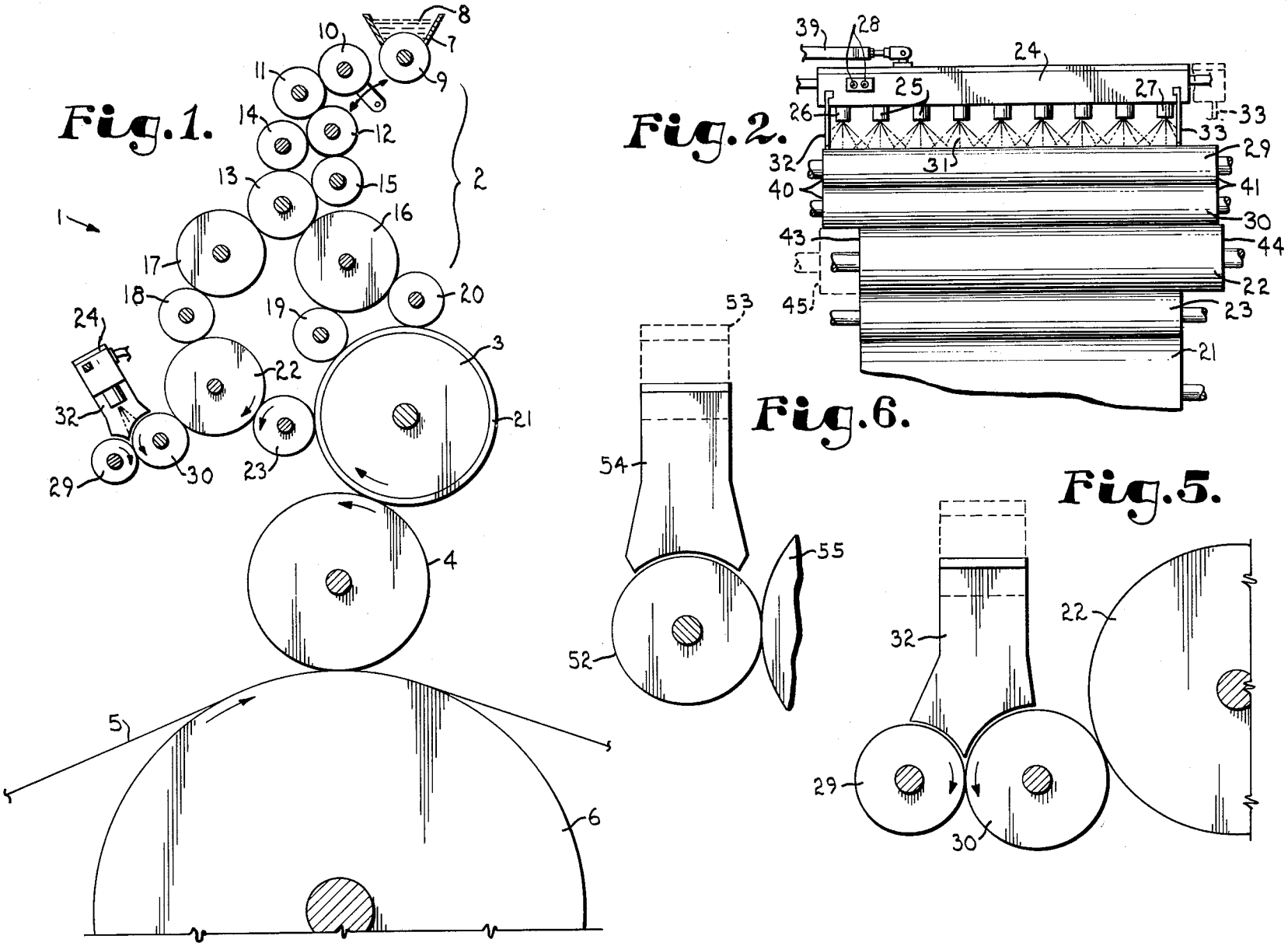
FIG. 1 is a schematic side elevation illustrating an offset printing press ink and one arrangement of moisture roller train embodying this invention.
FIG. 2 is a fragmentary, schematic, front elevation showing the relationship between a spray member and various rollers in the moisture train.
FIG. 5 is a fragmentary side elevational view showing the relationship between a spray member end shield and a pair of dampening rollers.
FIG. 6 is a view similar to FIG. 5 but showing a modified form which utilizes a single dampening roller.
Figure 3:
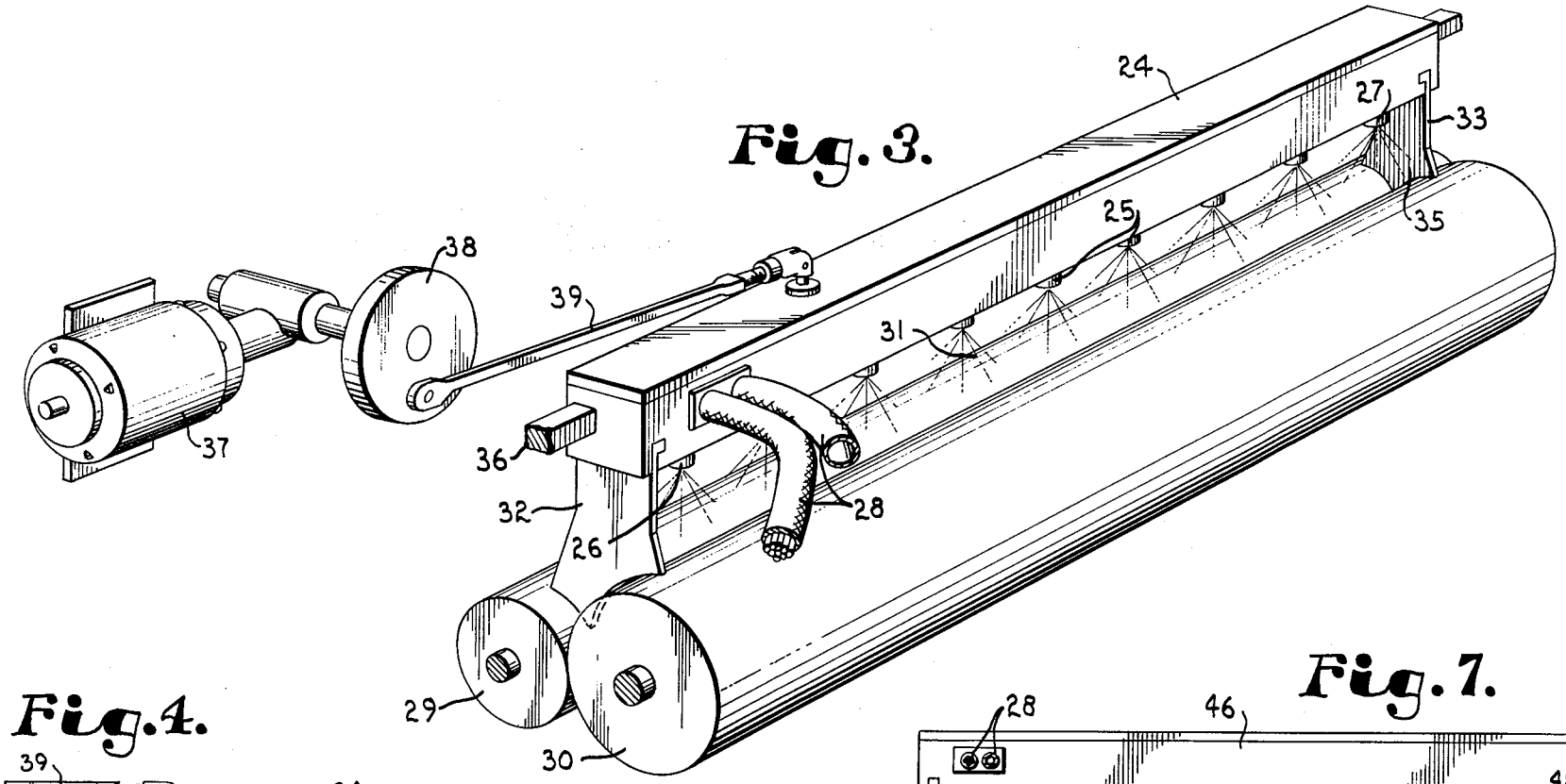
FIG. 3 is a fragmentary perspective view further illustrating the relationship between a spray member and dampening rollers.

Referring to the drawings in more detail:

Reference numeral 1 (FIG. 1) generally indicates a printing press incorporating dampening apparatus embodying this invention. The press 1 has an inking train, generally designated 2, which carries ink to an offset plate cylinder 3 engaging a blanket cylinder 4 for transferring an ink image thereto. The image is deposited, in this example, upon a paper web 5 which is backed by a suitable impression cylinder 6.

The inking train 2 is comprised of an inking fountain 7 containing, in this example, suitable paste ink 8 which is fed to a hard surface fountain roller 9 and carried by a reciprocating, resilient surface ductor roller 10 to a hard surface distributor roller 11. Resilient surface distributor rollers 12 and 13 and hard surface distributor rollers 14 and 15 operate to smooth the ink film and transfer it to hard surface vibrator roller 16 and further distributor rollers 17 and 18, the vibrator roller 16 being in contact with resilient surface form rollers 19 and 20 which deposit the ink film, where appropriate, onto a printing plate 21 carried by the plate cylinder 3. The distributor roller 18 runs in contact with a vibrating or oscillating roller 22 which, in this example, contacts a further form roller 23 in operative engagement with the printing plate 21.

An elongated spray member or bar 24, preferably of the general type described in U.S. Pat. No. 3,651,756, has several aligned, liquid atomizing, spray nozzles 25 positioned in laterally spaced relation, the group including end nozzles 26 and 27. The nozzles 25 are fed through suitable sources (not shown) connected by flexible liquid and compressed air lines 28.

In the example of FIGS. 1, 2, 3 and 5, a pair of contacting, resilient surface (e.g., 25–30 durometer) dampening rolls 29 and 30 are positioned to receive spray mist 31 from the respective nozzles 25 and each has a length less than the spray path width emitted from the combined nozzles, as explained further below. A pair of spray shields 32 and 33 are mounted on the spray bar 24 and respectively positioned near opposite ends of the line of spray nozzles 25. The shields 32 and 33, in this example, project into close relation to the dampening rollers 29 and 30 and respectively have inside surfaces 34 and 35 positioned to intersect a portion of the spray emitted from the end nozzles 26 and 27, which otherwise would be directed past the ends of the dampening rollers.

In the example of FIGS. 1–4, the spray bar 24 is suitably mounted upon a rod 36 for lateral reciprocal motion along the dampening rollers 29 and 30. A motor 37 is illustrated as driving a crank arrangement 38 to produce the reciprocation through an appropriate connecting link 39, however, it is to be understood that any suitable means of reciprocal mounting and driving may be utilized for the purpose, including a mechanical take-off from the printing press drive (not shown).

The length of the dampening rolls 29 and 30, that is, the distance between the ends 40 and 41 thereof, is greater than the distance between the spray shield inside surfaces 34 and 35, however, the spray path of the nozzles 25, including the distance of the spray bar crank stroke 43 (FIG. 4), is greater than the length of the rolls 29 and 30 to better provide uniform moisture application to the rolls. The inside surfaces 34 and 35 are positioned to prevent the resultant overspray beyond the ends 40 and 41 from entering bearings and wetting adjacent structure. Liquid dripping from free dripping lower portions of the shields 32 and 33 strikes the dampening roller or rollers and is milled into a uniformly thin moisture film formed on the roller 30 by coaction with the roller 29; note the bight formed therebetween, FIG. 1.

The oscillating roller 22 contacts the roller 30, in addition to the wet form roll 23 and distributing roll 18, for further smoothing and transferring moisture to the plate 21. The oscillating roller 22 has a length or distance between ends 43 and 44 generally equal to the length of the form roller 23 plus the stroke length of the oscillating roller 22, in FIG. 2. To complete the proper relationship, the dampening rollers 29 and 30 have a length slightly less, for example around ⅛ inch, than the length of the oscillating roll 22 plus the oscillating roll stroke length 45.

Operating parameters may vary considerably in the practice of the invention, however, recommended stroke length of the reciprocating spray bar for typical 17 to 20 inch web presses range from ¾ of an inch to 4 inches and oscillating speed preferably varies with operating press speed, a suitable relationship being 150 bar strokes per minute when the press is rotating at a speed of 1,000 web feet per minute. Also, it is desirable to control the relative diameters of the dampening, oscillating and form rollers so that there is no continuously repeating relationship which would tend to affect the smooth application of the moisture film. This avoidance of continuously repeating relationships should also be considered in determining the reciprocating frequency of the spray bar 24 and oscillating roll 22.

Figure 7:
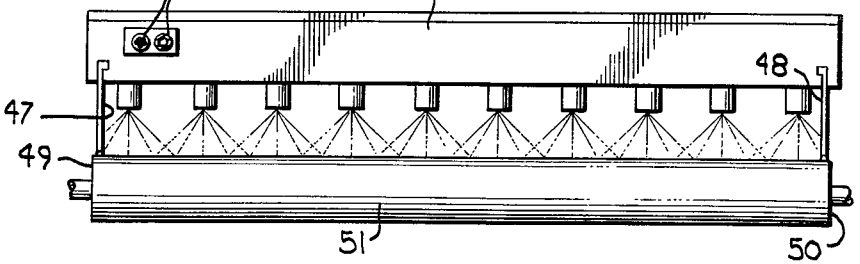
FIG. 7 is similar to FIG. 4 but showing a modified form utilizing a stationary spray member.
Figure 4:
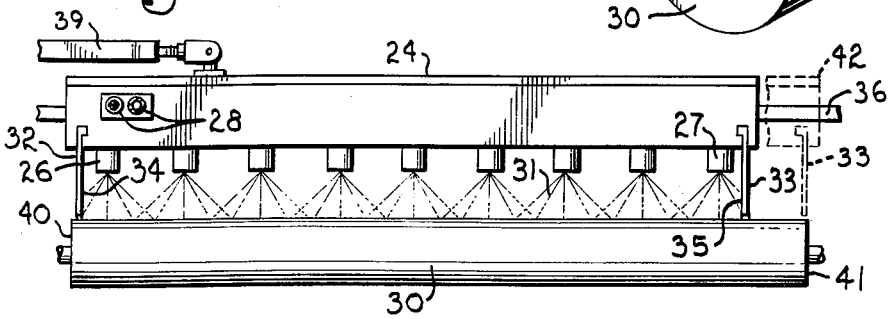
FIG. 4 is a fragmentary, schematic, front elevation similar to FIG. 2 but on a larger scale and showing the end-overspray relationship between the spray bar and a moisture receiving roller.

FIG. 7 illustrates a form of the invention wherein the spray bar 46 is stationary. In this embodiment, the spray shield inside surfaces 47 and 48 do not move but are continually located just inside the ends 49 and 50 of the dampening roller 51 receiving the spray, thereby preventing overspray, as described above, due to the spray path being greater in width than the distance between the ends 49 and 50. Excess moisture collecting on the surfaces 47 and 48 drips from the free dripping lower portions of the spray shields onto the dampening roller or rollers and is milled into the uniformly thin moisture film carried to the printing plate.

FIG. 6 illustrates a further modified form of this invention which utilizes a single dampening roller 52 co-acting with the spray bar 53 and spray shields 54, instead of the pair of dampening rollers described above. In the embodiment of FIG. 6 the dampening roll 52 receives the spray or mist from the spray bar 53 and carries it directly to the oscillating roll 55 for thin film formation and delivery along the roller train.

Figure 8:
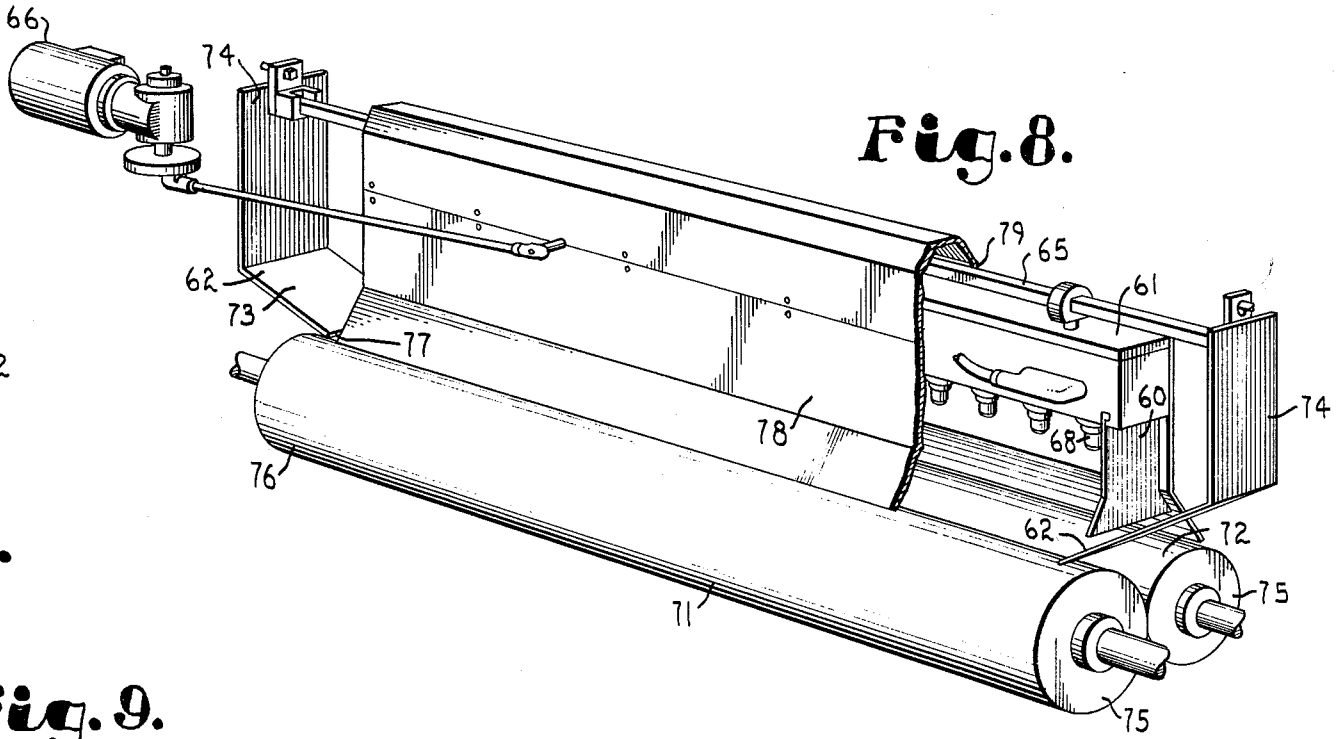
FIG. 8 is a view similar to FIG. 3 but showing a modified form of shield arrangement.
Figure 9:
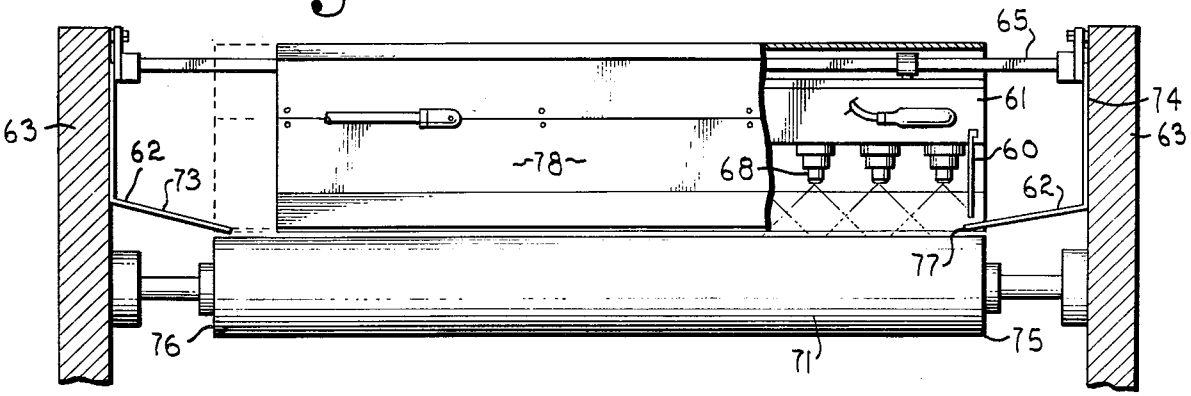
FIG. 9 is a fragmentary, schematic, front elevation of the structure of FIG. 8.
Figure 10:
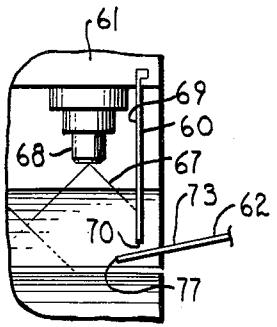
FIG. 10 is a fragmentary front elevation, on an enlarged scale, showing the shield arrangement of FIG. 9.

FIG. 8 illustrates a still further modified form of this invention wherein spray shield means at opposite ends of the spray path comprise first shields 60 mounted on the spray bar 61, and reciprocable therewith, and second shields 62 fixed with respect to the frame 63 of the press. In this embodiment, as the spray bar 61 is reciprocated on a supporting slide member 65 by a suitable drive device 66, the first spray shields 60 partially intersect the side spray 67 of the end nozzles 68 regardless of the reciprocal position of the spray bar 61. Liquid collected on the inner surface 69 of the first spray shields 60 drip from lower portions or edges 70 thereof onto the dampening rollers 71 and 72 or onto the upper surface 73 of the second shields 62.

The second shields 62, in this example, are secured by a vertical leg 74 to the press frame 63 and extend at a relatively shallow angle inwardly over the ends 75 and 76 of the rollers 71 and 72. A lower portion or edge 77 of the second shields 62 project between the lower edges 70 of the first shields 60 and the ends 75 and 76 of the rollers when the spray bar 61 is at the lateral limits of reciprocatory travel. The second shields 62 receive, on the surface 73, spray 67 and dripping moisture from the first spray shields 60, and the collected liquid is permitted to drip off the edge 77 onto the rollers 71 and 72. Thus, the use of a dampening roller end overspray pattern is permitted for more uniform moisture application, but without the undesirable wetting of adjacent press structure.

Front and rear shields 78 and 79 are mounted on the spray bar 61 and are suitably shaped to limit the escape of spray particles without interfering with the spray pattern. Should sufficient moisture collect on the inner surface 80 of the shields 78 and 79 to form running droplets, dripping will occur from the lower edges 81 thereof, which are positioned just above the rollers 71 and 72 for receiving same.

Figure 14:
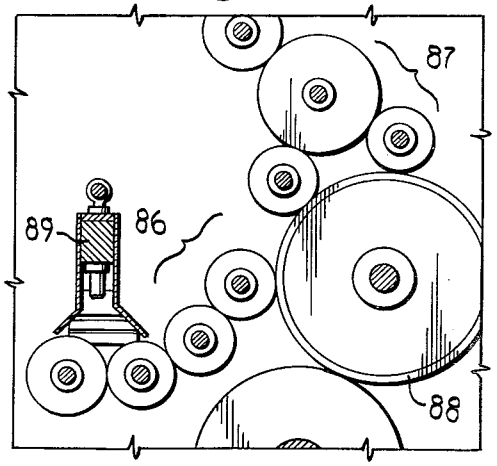
FIG. 14 is a fragmentary, schematic view similar to FIG. 1 but showing a modified arrangement of moisture roller train embodying this invention.
Figure 12:
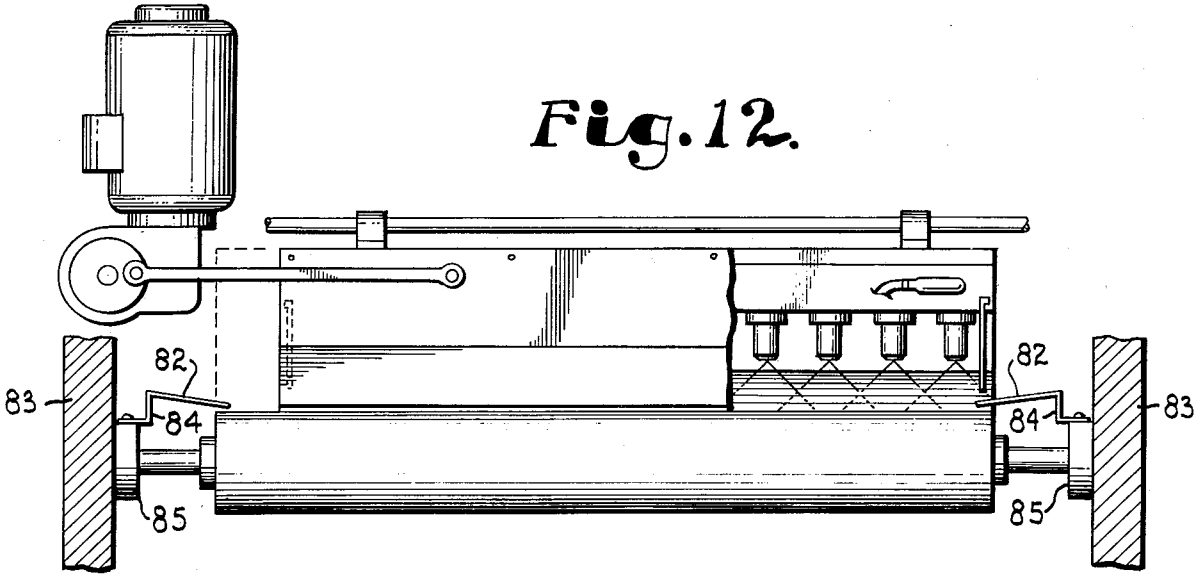
FIG. 12 is a view similar to FIG. 9 but showing a further modified form of shield arrangement.
Figure 13:
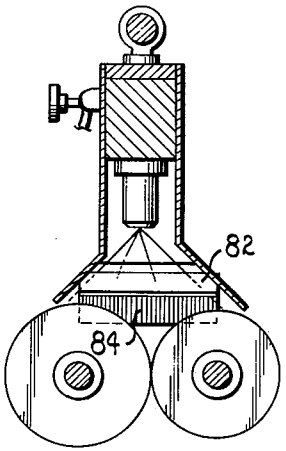
FIG. 13 is a view similar to FIG. 11 but showing the shield arrangement of FIG. 12.
Figure 11:
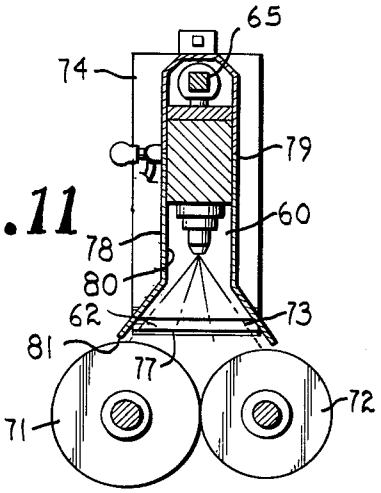
FIG. 11 is a fragmentary, cross-sectional, end elevation showing the shield arrangement of FIG. 9.

FIGS. 12 and 13 show structure similar to that described in connection with FIGS. 8–11, except that the second shields 82 are supported in fixed position with respect to the press frame 83 by a downwardly and outwardly extending bracket portion 84 secured to the dampener roller bearing housing 85. FIG. 14 is similar to FIG. 1 but showing a somewhat different dampening arrangement wherein the moisture train 86 does not contact the inking members 87 until deposit on the plate cylinder 88 and the spray bar 89 is directed substantially vertically.

In operation, a highly uniform and effective film of moisture is transferred to the printing plate for high quality offset printing without dampening roller overspray and without overspray disposal problems.

It is to be understood that, while certain embodiments of this invention have been illustrated and described, it is not to be limited thereto except insofar as such limitations are included in the following claims.

I claim:

1. In combination with a printing press having a frame, an inking train and an offset plate cylinder which engages a blanket cylinder for transferring an ink image thereto, dampening apparatus comprising:

a. an elongated spray member having a line of several dampening liquid atomizing spray nozzles positioned on said press in laterally spaced relation; means reciprocating said spray member laterally of said press;

b. dampening roller means having opposite ends, said dampening roller means being positioned to receive spray from said nozzles and having a length between said roller means ends less than the spray path width emitted from said nozzles, including said reciprocation, whereby said spray path extends beyond said roller means ends;

c. a pair of spray shield means associated with said spray member and respectively positioned to intersect and prevent overspray beyond said roller means ends;

d. said spray shield means respectively having a first shield and a second shield each with free dripping lower portions positioned over said roller means, said first shield being mounted on said spray member and said second shield being fixed with respect to said frame, whereby intersected spray is dripped onto said roller means; and e. transfer means contacting said dampening roller means and transferring moisture to said plate cylinder.

2. In combination with a printing press having a frame, an inking train and an offset plate cylinder which engages a blanket cylinder for transferring an ink image thereto, dampening apparatus comprising:

a. an elongated spray member having a line of several dampening liquid atomizing spray nozzles positioned on said press in laterally spaced relation;

b. dampening roller means having opposite ends, said dampening roller means being positioned to receive spray from said nozzles and having a length between said roller means ends less than the spray path width emitted from said nozzles, whereby said spray path extends beyond said roller means ends;

c. spray shield means associated with said spray member and positioned to intersect and prevent overspray beyond said roller means ends;

d. said spray shield means extending inwardly and downwardly from a position beyond said roller means ends to a position over said roller means ends, said spray shield means having free dripping lower portions positioned over said roller means ends, whereby intersected spray is dripped onto said roller means; and e. transfer means contacting said dampening roller means and transferring moisture to said plate cylinder.

3. The combination as set forth in claim 2 wherein said spray shield means comprises:

a. a first spray shield mounted on said spray member and projecting downwardly therefrom, and b. a second spray shield fixed with respect to said frame and extending inwardly and downwardly over said roller means.

4. The combination as set forth in claim 3 wherein:

a. said second spray shield at least periodically extends beneath said first spray shield.

5. The combination as set forth in claim 3 wherein:

a. said first spray shield has a spray intersecting portion, and b. said second spray shield has a spray intersecting portion extending at a substantially lesser angle to the horizontal than said first spray shield intersecting portion.

* * * * *